US010927704B2

(12) United States Patent
Delong

(10) Patent No.: US 10,927,704 B2
(45) Date of Patent: Feb. 23, 2021

(54) COOLING CONFIGURATION FOR A COLD GAS TURBINE GENERATOR ASSEMBLY

(71) Applicant: Hamilton Sundstrand Corporation, Charlotte, NC (US)

(72) Inventor: Zachary J. Delong, Roscoe, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 139 days.

(21) Appl. No.: 15/982,423

(22) Filed: May 17, 2018

(65) Prior Publication Data

US 2019/0353049 A1 Nov. 21, 2019

(51) Int. Cl.
*F01D 25/12* (2006.01)
*F01D 15/10* (2006.01)

(52) U.S. Cl.
CPC ..... *F01D 25/12* (2013.01); *F01D 15/10* (2013.01); *F05D 2220/76* (2013.01); *F05D 2260/213* (2013.01); *F05D 2260/22141* (2013.01); *F05D 2260/53* (2013.01)

(58) Field of Classification Search
CPC ..... F01D 25/12; F01D 15/10; F05D 2220/76; F05D 2260/213; F05D 2260/53
See application file for complete search history.

(56) References Cited

U.S. PATENT DOCUMENTS 6,968,673 B1 11/2005 Knight
8,341,933 B2 1/2013 Greason et al.
8,585,358 B2 * 11/2013 Matsuo ..... F03D 80/88 415/176
8,646,564 B2 * 2/2014 Khadiya ..... F01N 3/023 180/301
10,181,800 B1 * 1/2019 Nayar ..... H02J 7/00
2004/0007452 A1 * 1/2004 Warren ..... B01D 61/002 204/155
2006/0042262 A1 * 3/2006 Ganev ..... F02C 9/28 60/773
2013/0334818 A1 * 12/2013 Mashal ..... H02P 9/107 290/44

(Continued)

FOREIGN PATENT DOCUMENTS

JP 2011135630 A * 7/2011

OTHER PUBLICATIONS

Wind Turbine Waste Heat Recovery—A Short-Term Heat Loss Forecasting Approach; George Xydis, George Pechlivanoglou and Navid Christian Nayeri (Year: 2015).*

(Continued)

*Primary Examiner* — Gordon A Jones
(74) *Attorney, Agent, or Firm* — Carlson, Gaksey & Olds, P.C.

(57) ABSTRACT

A turbine generator assembly includes a turbine drivably connected to an electrical generator. The turbine includes a propellant input and a spent propellant exhaust. The spent propellant exhaust is connected to an exhaust flow path. An electrical component is connected to an output of the electrical generator such that the electrical component is powered by the electrical generator. A first heat exchanger including a cooling fluid inlet is connected to the exhaust flow path and a cooled feature is configured to be cooled by fluid received through the cooling fluid inlet. The cooled feature is at least a portion of the electrical component.

16 Claims, 2 Drawing Sheets

(56) References Cited

U.S. PATENT DOCUMENTS

| | | | | |
|---|---|---|---|---|
| 2016/0102581 | A1* | 4/2016 | Del Bono | F01D 25/28<br>290/1 A |
| 2017/0082035 | A1* | 3/2017 | Geiger | F02C 9/28 |
| 2017/0130614 | A1* | 5/2017 | Held | F01K 23/02 |
| 2017/0248076 | A1* | 8/2017 | Dierksmeier | F02C 7/185 |
| 2017/0350319 | A1* | 12/2017 | Wu | F02C 9/50 |
| 2018/0370651 | A1* | 12/2018 | Miller | B64D 45/00 |
| 2019/0052206 | A1* | 2/2019 | Noderer | F01D 21/14 |

OTHER PUBLICATIONS

JP 2011135630 A machine translation (Year: 2011).*

* cited by examiner

COOLING CONFIGURATION FOR A COLD GAS TURBINE GENERATOR ASSEMBLY

TECHNICAL FIELD

The present disclosure relates generally to cooling systems associated with a cold gas generator assembly, and more specifically to a system for utilizing turbine exhaust from a cold gas generator assembly to cool an electrical system.

BACKGROUND

Land based vehicles, such as heavy trucks, can incorporate one or more high power dissipation electrical components. Due to the high magnitudes of power dissipation in such electrical components, the electrical components generate extreme amounts of heat. The extreme heat can damage the electrical component, the generator generating the power, or any other surrounding systems. In order to prevent damage to the electrical component or to the surrounding systems, cooling is provided to the electrical component.

SUMMARY OF THE INVENTION

In one exemplary embodiment a turbine generator assembly includes a turbine drivably connected to an electrical generator, the turbine including a propellant input and a spent propellant exhaust, the spent propellant exhaust being connected to an exhaust flow path, an electrical component connected to an output of the electrical generator such that the electrical component is powered by the electrical generator, and a first heat exchanger including a cooling fluid inlet connected to the exhaust flow path and a cooled feature configured to be cooled by fluid received through the cooling fluid inlet, wherein the cooled feature is at least a portion of the electrical component.

In another example of the above described turbine generator assembly the cooled feature is a cooled fluid loop configured to cool the electrical component.

In another example of any of the above described turbine generator assemblies the cooled feature is a convective cooling surface of the electrical component.

In another example of any of the above described turbine generator assemblies the convective cooling surface includes at least one cooling fin protruding into cooling fluid flowpath of the first heat exchanger.

Another example of any of the above described turbine generator assemblies further includes a second heat exchanger including a cooling fluid inlet connected to the exhaust flow line, a cooling fluid outlet connected to the exhaust flow line, and a cooled fluid outlet connected to a gear system, the gear system mechanically connecting the turbine to the electrical generator.

In another example of any of the above described turbine generator assemblies the second heat exchanger further comprises a cooled fluid inlet connected to the electrical generator, and wherein a cooled fluid path passes through the gear system to the electric generator.

In another example of any of the above described turbine generator assemblies the second heat exchanger is disposed between the spent propellant exhaust and the cooling fluid inlet of the first heat exchanger.

In another example of any of the above described turbine generator assemblies the turbine is a cold gas driven turbine.

In another example of any of the above described turbine generator assemblies the propellant input is a metered nozzle configured to expand and supercool a propellant entering the turbine.

In another example of any of the above described turbine generator assemblies the electrical component is a high energy discharge device.

In another example of any of the above described turbine generator assemblies the high energy discharge device has an efficiency of at most 50%.

Another example of any of the above described turbine generator assemblies further includes a turbine housing containing the turbine, the electrical generator and the first heat exchanger.

An exemplary method for cooling a high energy discharge device includes passing at least a portion of an exhaust stream of a cold gas driven turbine through a first heat exchanger, the first heat exchanger being configured to provide cooling to the high energy discharge device.

Another example of the above described method for cooling a high energy discharge device further includes cooling a cooled fluid in the first heat exchanger, and passing the cooled fluid through a cooling loop of the high energy discharge device.

Another example of any of the above described methods for cooling a high energy discharge device further includes cooling a convective cooling surface of the high energy discharge device by passing the at least the portion of the exhaust stream of the cold gas driven turbine over the convective cooling surface in the first heat exchanger.

In another example of any of the above described methods for cooling a high energy discharge device passing the exhaust stream of the cold gas driven turbine over the convective cooling surface further includes passing the at least the portion of the exhaust stream along at least one cooling fin extending from the convective cooling surface into the exhaust stream.

Another example of any of the above described methods for cooling a high energy discharge device further includes passing the at least a portion of the exhaust stream through a second heat exchanger upstream of the first heat exchanger.

Another example of any of the above described methods for cooling a high energy discharge device further includes cooling at least one of a gear system connecting a turbine to an electrical generator within the cold gas driven turbine and the electrical generator using an output of the second heat exchanger.

In one exemplary embodiment a land based vehicle includes a propellant source, a cold gas turbine generator assembly including a turbine, a generator, and a first heat exchanger, a high power discharge electrical component electrically coupled to the generator, and coupled to the first heat exchanger such that exhaust from the turbine cools the high power discharge electrical component via the first heat exchanger.

Another example of the above described land based vehicle further includes a second heat exchanger upstream of the first heat exchanger, relative to a flow of exhaust from the turbine, the second heat exchanger being configured to cool at least one of the electrical generator and a gear system connecting the turbine to the electrical generator.

These and other features of the present invention can be best understood from the following specification and drawings, the following of which is a brief description.

DETAILED DESCRIPTION

Figure 1:
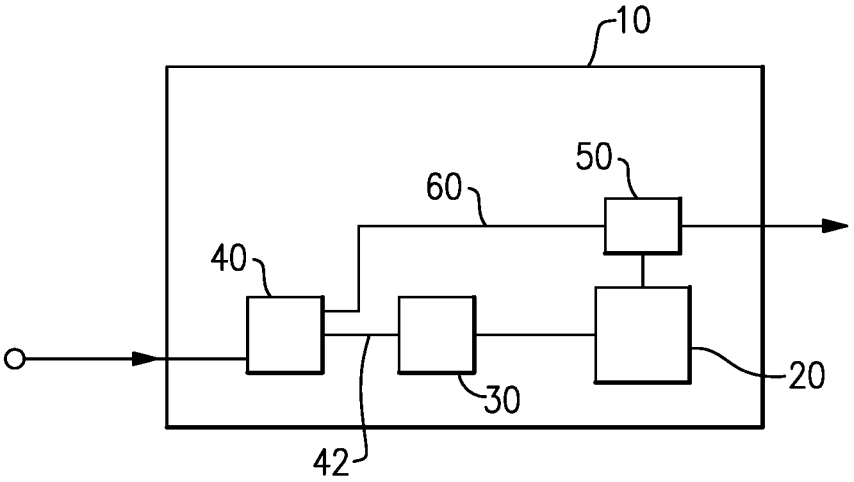
FIG. 1 schematically illustrates a land based vehicle according to a first embodiment.

FIG. 1 schematically illustrates a land based vehicle 10. The land based vehicle 10 includes a high power dissipation electrical component 20. The high power dissipation electrical component 20 can be any electrical component or system that utilizes a large amount of power and has a low efficiency for converting the power to a desired action. In some examples, the high power dissipation electrical component 20 can have an efficiency of lower than 50%. In alternative examples, the efficiency can be at most 25%.

Due to the high power requirements for the high power dissipation electrical component 20, the vehicle 10 includes a dedicated electrical generation system. The dedicated electrical generation system includes an electrical generator 30 and a cold gas turbine 40. The dedicated electrical generation system provides the operational electric power to the high power dissipation electrical component 20. The cold gas turbine 40 receives a cooled propellant gas, and the cooled propellant gas drives the cold gas turbine 40 to rotate according to any conventional turbine system. Rotation of the turbine 40 is passed to the electrical generator 30 via a shaft 42. The rotation drives the electrical generator 30 to generate electricity, and the electricity is provided to the high power dissipation electrical component 20 via any conventional power distribution system.

The pressurized propellant provided to the cold gas turbine 40 is expanded across the turbine 40, and is exhausted from the turbine 40 in a super cooled state. In some examples, the exhaust gas can be in the range of −300-150 degrees F. (−184.4-101.11 degrees C.). In order to cool the high power dissipation electrical component 20, a heat exchanger 50 intercepts the exhaust flow 60 and transfers heat from the high power dissipation electrical component 20 to the exhaust flow 60. The output of the heat exchanger 50 is then returned to the exhaust flow 60 and exhausted from the vehicle 10. In some examples, the heat exchanger 50 utilizes the entire exhaust flow 60 in the heat exchange process. In alternative examples, only a portion of the exhaust flow 60 is redirected through the heat exchanger 50.

Figure 2:
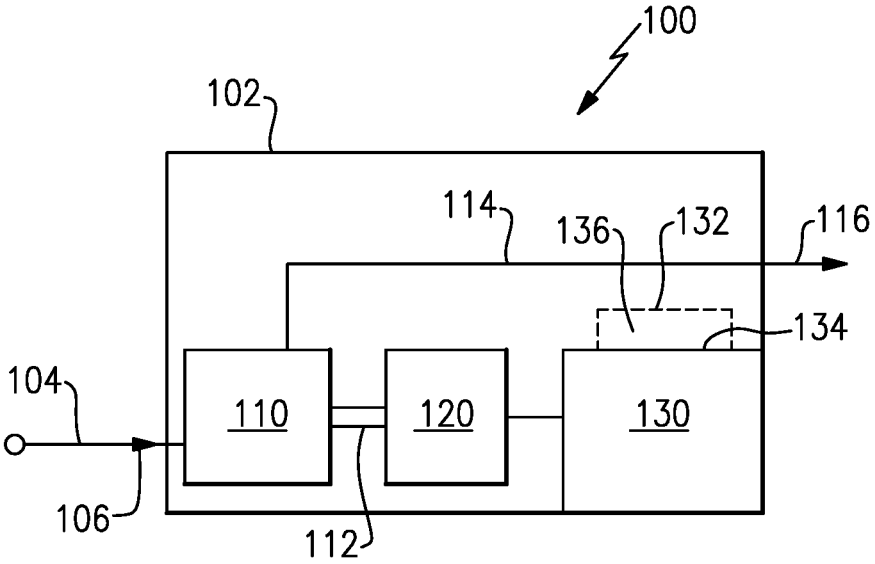
FIG. 2 schematically illustrates a more detailed land based vehicle according to a second embodiment.

With continued reference to FIG. 1, FIG. 2 schematically illustrates an exemplary cold gas turbine generator assembly 100 including a turbine 110 and a generator 120 contained within a turbine system 102. The cold gas turbine generator assembly 100 includes a cold gas inlet 104 that receives pressurized propellant from a propellant source 401 (illustrated in each of FIGS. 1-4), and provides the pressurized propellant to the turbine 110. In some examples, the pressurized propellant can be sourced from canisters storing pre-pressurized propellant. In alternative examples, the propellant can be sourced from a gas generator on board the vehicle 100. In yet further examples the propellant can be sourced from a combination of the two. The propellant is provided to the turbine 110 through a nozzle 106. The nozzle 106 meters and expands the propellant as it is provided to the turbine 110. Expansion of the propellant through the nozzle further causes the gas to be super cooled resulting in very cold exhaust temperatures.

As the propellant is expanded across the turbine 110, the turbine 110 is driven to rotate. The rotation of the turbine 110 drives rotation of the generator 120 via a shaft 112 connecting the generator 120 to the turbine 110. The shaft 112 can be either a direct mechanical connection, as in the illustrated example, or a geared connection allowing the generator 120 to rotate at either a stepped up or a stepped down speed, relative to rotation of the turbine 110. Electrical power is provided from the generator 120 to a high power dissipation electrical component 130, which is outside of the turbine system 102. Spent propellant is exhausted from the turbine 110 along an exhaust flowpath 114, and is expelled from the turbine system 102.

A heat exchanger 132 thermally connects the exhaust flowpath 114 with the high power dissipation electrical component 130. In the illustrated example of FIG. 2, the heat exchanger 132 is a plate and fin heat exchanger that utilizes a convective surface 134 exposed to the exhaust flowpath 114 to directly cool the high power dissipation electrical component 130. The plate and fin heat exchanger 132 also includes one or more fins 136 protruding into the exhaust flowpath 114. Each of the fins 136 further enhances the cooling effect provided by the heat exchanger 132 by increasing the surface area of the heat exchanger 132 that is exposed to the exhaust flowpath 114.

Figure 3:
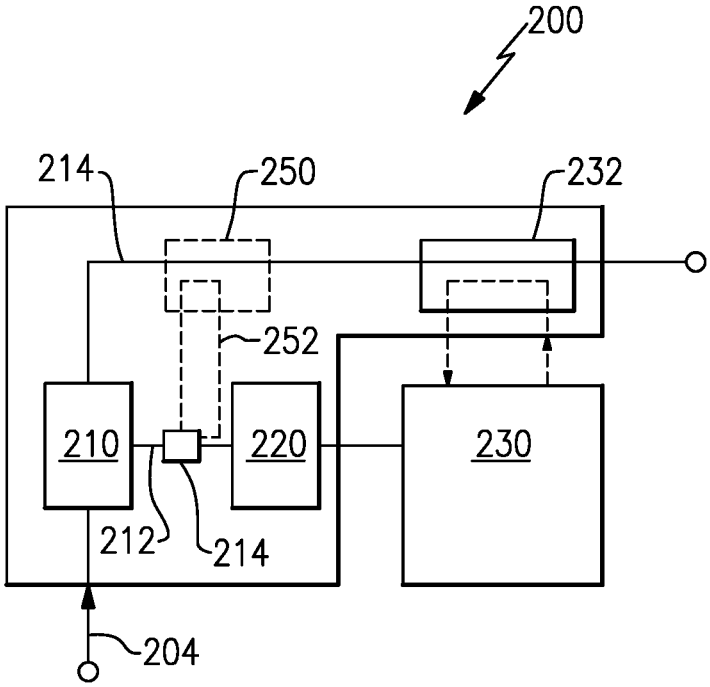
FIG. 3 schematically illustrates a more detailed land based vehicle according to a third embodiment.

With continued reference to the embodiments of FIGS. 1 and 2, FIG. 3 schematically illustrates an alternative embodiment of a cold gas turbine generator assembly 200 including a fluid based heat exchanger 232 for cooling a high power dissipation electrical component 230. As with the embodiment of FIG. 2, a turbine 210 receives a compressed propellant from a propellant source at a propellant input 204, expands the compressed propellant, and exhausts the spent propellant along an exhaust flowpath 214. The cold gas generator assembly 200 of FIG. 3 connects the turbine 210 to a generator 220 via shaft 212 connected to a gear system 214.

In order to lubricate and cool the gear system 214, a second heat exchanger 250 can be incorporated into the exhaust flowpath 214, and can cool the lubricant provided to the gear system 214 via a convention gas-oil heat exchange system. In one variation of the illustrated cold gas turbine generator assembly 200, a lubricant loop 252 that provides the cooled lubricant to the gear system 214, and returns the spent lubricant to the heat exchanger 250, is extended through the electrical generator 220. In this variation, the cooled lubricant further cools the generator 220 in addition to the gear system 214.

Figure 4:
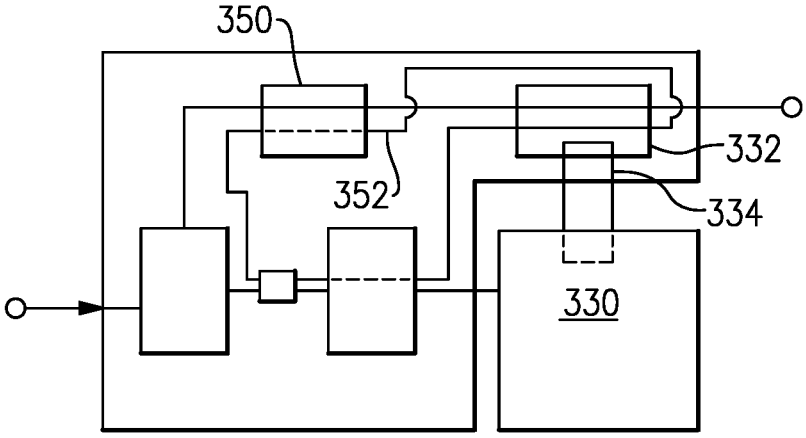
FIG. 4 schematically illustrates a more detailed land based vehicle according to a fourth embodiment.

With continued reference to FIG. 3, FIG. 4 schematically illustrates another example embodiment cold gas turbine generator assembly 300, utilizing heat exchangers 350, 332. Aside from the heat exchanger configuration, and the coolant flowpaths 352, 334, the embodiment of FIG. 4 is identical to the embodiment of FIG. 3. In the example of FIG. 4, the second heat exchanger 350 and the first heat exchanger 332 are cascaded, with the coolant loop 352 passing through the first heat exchanger 332 as the cooling fluid, and cooling a second coolant loop 334 that passes through the high power discharge electrical component 330.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A turbine generator assembly comprising:

a turbine drivably connected to an electrical generator;

the turbine including a propellant input and a spent propellant exhaust, the spent propellant exhaust being connected to an exhaust flow path, wherein the exhaust flow path exhausts the spent propellant from the turbine generator assembly;

an electrical component connected to an output of the electrical generator such that the electrical component is powered by the electrical generator, wherein the electrical component has a power discharge efficiency of at most 50% when converting electrical power to an action; and a first heat exchanger including a cooling fluid inlet connected to the exhaust flow path and a cooled feature configured to be cooled by fluid received through the cooling fluid inlet, wherein the cooled feature is at least a portion of the electrical component.

2. The turbine generator assembly of claim 1, wherein the cooled feature is a cooled fluid loop configured to cool the electrical component.

3. The turbine generator assembly of claim 1, wherein the cooled feature is a convective cooling surface of the electrical component.

4. The turbine generator assembly of claim 3, wherein the convective cooling surface includes at least one cooling fin protruding into cooling fluid flowpath of the first heat exchanger.

5. The turbine generator assembly of claim 1, further comprising a second heat exchanger including a second cooling fluid inlet connected to the exhaust flow line, a second cooling fluid outlet connected to the exhaust flow line, and a second cooled fluid outlet connected to a gear system, the gear system mechanically connecting the turbine to the electrical generator.

6. The turbine generator assembly of claim 5, wherein the second heat exchanger further comprises a third cooled fluid inlet connected to the electrical generator, and wherein a cooled fluid path passes through the gear system to the electric generator.

7. The turbine generator assembly of claim 6 wherein the second heat exchanger is disposed between the spent propellant exhaust and the cooling fluid inlet of the first heat exchanger.

8. The turbine generator assembly of claim 1, wherein the turbine is a cold gas driven turbine.

9. The turbine generator assembly of claim 1, wherein the propellant input is a metered nozzle configured to expand and supercool a propellant entering the turbine.

10. The turbine generator assembly of claim 1, further comprising a turbine housing containing the turbine, the electrical generator and the first heat exchanger.

11. The turbine generator assembly of claim 1, further comprising a pressurized propellant source connected to the propellant input.

12. The turbine generator of claim 11, wherein the pressurized propellant source comprises at least one pre-pressurized canister.

13. The turbine generator of claim 12, wherein the pressurized propellant source comprises at least one cold propellant generator.

14. The turbine generator assembly of claim 11, wherein the spent propellant exhaust has a temperature in the range of −300 to −150 degrees F. (−184.4 to −101.11 degrees C.).

15. The turbine generator of claim 11, wherein the turbine is configured such that expansion of the propellant across the turbine super cools the propellant.

16. The turbine generator assembly of claim 1, wherein the electrical component has a power discharge efficiency of at most 25% when converting electrical power to the action.

* * * * *